United States Patent [19]

Gander

[11] 4,389,196

[45] * Jun. 21, 1983

[54] WATERCRAFT WITH SWIVEL FIN DRIVE

[76] Inventor: Franz Gander, Feldweg 4, 6370 Stans-Oberdorf, Switzerland

[ * ] Notice: The portion of the term of this patent subsequent to Dec. 8, 1998, has been disclaimed.

[21] Appl. No.: 297,218

[22] Filed: Aug. 28, 1981

Related U.S. Application Data

[63] Continuation of Ser. No. 53,904, Jul. 2, 1979, Pat. No. 4,304,555.

[30] Foreign Application Priority Data

Jul. 5, 1978 [CH] Switzerland ..... 7321/78

[51] Int. Cl.[3] ..... B63H 1/36

[52] U.S. Cl. ..... 440/15; 114/345; 440/21; 440/29; 440/31

[58] Field of Search ..... 74/480 B; 114/345; 440/13-16, 21, 57, 31, 24, 29

[56] References Cited

U.S. PATENT DOCUMENTS

| | | | |
|---|---|---|---|
| 2,062,546 | 12/1936 | Wells | 440/14 |
| 2,668,513 | 2/1954 | Reynolds | 440/24 |
| 3,175,530 | 3/1965 | Petterson | 440/57 |
| 3,361,106 | 1/1968 | Hildebrand | 440/15 |
| 3,440,994 | 4/1969 | McGowan | 9/301 |
| 3,714,921 | 12/1981 | Gibson | 9/309 |
| 3,874,320 | 4/1975 | Wood | 440/15 |
| 4,304,555 | 12/1981 | Gander | 440/15 |

FOREIGN PATENT DOCUMENTS

| | | | |
|---|---|---|---|
| 521261 | 3/1931 | Fed. Rep. of Germany | 440/21 |
| 492418 | 7/1919 | France . | |
| 559158 | 6/1923 | France | 440/13 |
| 1077581 | 11/1954 | France | 440/16 |
| 644514 | 9/1962 | Italy | 440/15 |

*Primary Examiner*—Sherman D. Basinger

*Attorney, Agent, or Firm*—Werner W. Kleeman

[57] ABSTRACT

A watercraft, which is propelled by a swivellable propulsion fin, which extends from its swivel axle parallel to the longitudinal direction of the watercraft and which is swivellable laterally by a drive device. The swivellable propulsion fin is arranged on the stern of the watercraft in the prolongation thereof.

15 Claims, 8 Drawing Figures

WATERCRAFT WITH SWIVEL FIN DRIVE

CROSS REFERENCE TO RELATED CASE

This application is a continuation of my U.S. application Ser. No. 053,904, filed July 2, 1979, now U.S. Pat. No. 4,304,555 issued Dec. 8. 1981.

BACKGROUND OF THE INVENTION

The present invention concerns a new and improved construction of watercraft with swivel fin drive, for which a propulsion fin is provided, which is swivellable laterally by drive equipment and which, from its vertical swivel axle, extends parallel to the longitudinal direction of the watercraft.

Such watercrafts, the propulsion motions of which often take place through muscular power of the user, are in themselves known in the art. In these state-of-the-art watercraft, the propulsion fin consists of a separate element. Such is generally produced of flexible material and is fastened to a vertical swivel lever underneath the watercraft. A vertical prolongation of this swivel lever extends upwardly into the interior of the watercraft and is guided rotatably in the boat shell. This prolongation of the swivel lever is driven by drive equipment which is provided in the interior of the boat or on the deck. An example of application of such swivel fin drive for a watercraft is disclosed in German patent publication No. 2,440,369. In the case of this exemplary field of application, the drive fin is disposed directly behind the keel of the watercraft.

The arrangement of a laterally swivellable propulsion fin underneath the watercraft has the disadvantage of requiring a great deal of space. Furthermore, a certain risk results therefrom of damaging the mechanism consisting of propulsion fin, swivel lever and associated drive equipment. Thus, for example, during transport, the swivel lever can be bent, whereby the mechanism would no longer function properly. A relatively great draft also results from this arrangement of the propulsion fin, for which reason the watercraft cannot be used in shallow waters. The propulsion fin, which is moved relatively far laterally below the water level, requires that the floating body or hull of the watercraft is dimensioned to be large, in order to impart to the watercraft the necessary lateral stability. The swivel lever guided from below through the shell or hull of the boat presupposes a perfect and durable sealing of this penetration point. This sealing is difficult to execute and consequently makes the watercraft more expensive.

SUMMARY OF THE INVENTION

Therefore, it is a primary object of the present invention to devise a relatively simple and cheap watercraft with swivel fin drive, in which the propulsion fin demands little space and is protected against damage, while the watercraft requires no complicated sealing and is laterally stable even with relatively small dimensions of the floating body or the like.

This problem is solved according to the invention in that the propulsion fin is arranged at the stern in the prolongation of the watercraft.

According to a preferred embodiment, the vertical swivel axle of the propulsion fin is provided as a drive shaft, which together with an actuating lever rotatable about a vertical axis of rotation forms at least a part of the drive equipment or device of the propulsion fin.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 2:
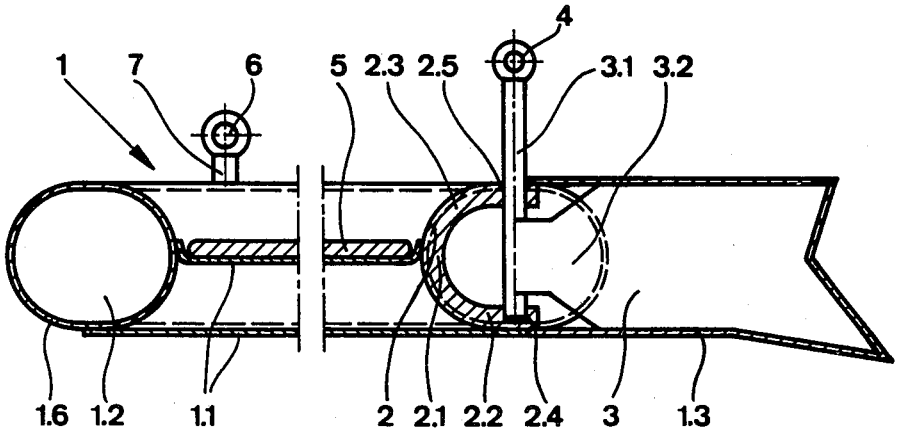
FIG. 2 is a longitudinal sectional view through the watercraft illustrated in FIG. 1.
Figure 1:
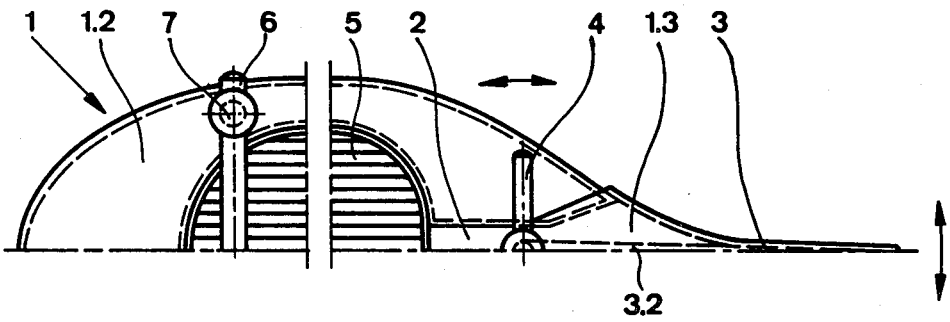
FIG. 1 illustratives one-half of a plan view of a first embodiment of watercraft with swivel fin drive according to the invention.

Describing now the drawings, the exemplary embodiment of watercraft illustrated in FIGS. 1 and 2 comprises, for instance, an air boat which is constructed as a hose boat 1. The boat body of this hose boat 1 consists of an inflatable torus or hose-like element 1.2, which has the form of a loop which is not closed at the stern. Both ends of the torus or hose-like element 1.2 are closed-off so as to be airtight.

Disposed between both of the not particularly referenced torus ends is a U-shaped bracket 2, which, for instance, consists of a yoke 2.1 and two legs or limbs 2.2 and 2.3. The end faces of the legs or limbs 2.2 and 2.3 and of the yoke 2.1 are firmly connected with both of the torus ends. Both of the legs 2.2 and 2.3 of the bracket 2 are essentially horizontally arranged and each is provided with a respective bearing 2.4 and 2.5 or equivalent structure, in which there is guided a vertical swivel shaft or axle 3.1, constructed as a drive shaft, of a propulsion fin 3. The propulsion fin 3 has an impact surface and extends from its vertical swivel axle or pivot shaft 3.1 essentially parallel to the longitudinal direction of the watercraft rearwardly out of the watercraft. The swivel axle or shaft 3.1 of the propulsion fin 3 is thus arranged within the contour of the boat and the propulsion fin 3 itself is disposed at the stern in the prolongation 1.3 of the watercraft. The core of the propulsion fin 3 consists of a plate 3.2 and is preferably produced of any suitable flexible synthetic material. The plate 3.2 is nearly rigid in the proximity of the swivel axle or shaft 3.1 and becomes more flexible with increasing spacing therefrom. Both the torus ends are connected watertight with the propulsion fin 3 by means of a flexible material constituting seal means, wherein the flexible material can be a part of the boat skin 1.6 of the pneumatic hose boat 1 and at least partially encompasses the propulsion fin 3, the figures showing a full envelopment of the fin by the flexible material such as the boat skin 1.6. The flexible material forms a prolongation of the boat skin 1.6 of the pneumatic hose boat 1.

The drive equipment or device of the pneumatic hose boat 1 embodies the drive shaft 3.1 and an actuating lever 4 driven, for instance, by muscle power i.e., manually. The actuating lever 4 is fastened at right angles and at its center region to the upper part of the drive shaft 3.1 protruding upwardly from the pneumatic hose boat 1. Continuing, the pneumatic hose boat 1 contains a supporting rod 6 or equivalent as well as a double bottom or floor 1.1, on the upper surface of which lies a deckboard 5 or the like. The supporting rod 6 is fastened to the torus 1.2 by means of two stays 7 in the bow of the pneumatic hose boat 1.

A user lies on the deckboard 5 of the pneumatic hose boat 1 and manually grips the support rod 6. At the same time, he or she swivels the actuating lever 4 by his or her feet, whereby the watercraft is propelled forwards.

The flexibility of the propulsion fin 3 can be controlled by the movements of the propulsion fin 3 itself. For this purpose, the prolongation 1.3 is fastened to the plate 3.2 of the propulsion fin 3 only at a point which is relatively far removed from the swivel axle or shaft 3.1. Furthermore, stationary or fixed parts 1.4 and 1.5 (FIG. 3) are provided to each side of the swivel axle 3.1 of the propulsion fin 3 laterally on the stern of the watercraft and are connected firmly with one another, for example by an additional, not illustrated connecting element, and have the boat skin 1.6 of the pneumatic hose boat 1 fastened to them.

Figure 3:
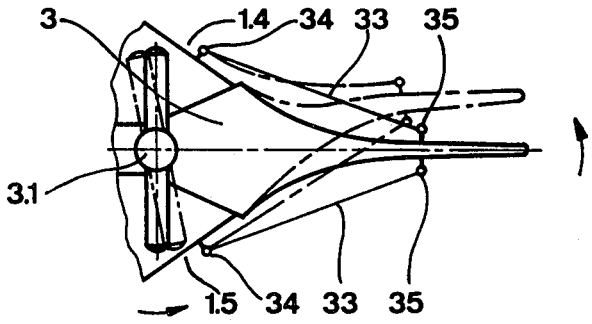
FIGS. 3 to 5 illustrate three constructional variants of the propulsion fin of the watercraft.

In the variant shown in FIG. 3, the flexibility of the propulsion fin 3 is influenced by ropes or cables 33 or equivalent structure, which are arranged to both sides of the propulsion fin 3 symmetrically with respect to the longitudinal axis of the pneumatic hose boat 1. The one respective end of these ropes 33 are fastened by means of eyelets 34 or equivalent fixing means to the fixed or stationary parts 1.4 and 1.5 of the stern of the pneumatic hose boat 1 and their other ends are fastened by means of further eyelets 35 or equivalent fixing means to the propulsion fin 3. When the operator or user now swivels the propulsion fin 3 out of its rest position, then a part of the ropes 33 is tightened. Consequently, the propulsion fin 3 bends elastically. This influences the propulsion of the pneumatic hose boat 1.

Figure 4:
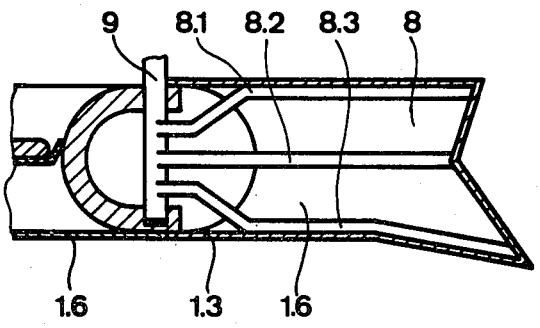

FIG. 4 shows a further constructional variant of the propulsion fin. Here, the propulsion fin 8 comprises a framework or structural assembly which is formed by a swivel axle of shaft 9, provided as a drive shaft, and rods or struts 8.1, 8.2 and 8.3 firmly connected therewith. Analogously to the described plate 3.2 of FIGS. 1 and 2, the rods 8.1, 8.2 and 8.3 become more flexible towards their outer ends. Between the rods 8.1, 8.2 and 8.3, the impact surface of the propulsion fin 8 consists of the boat skin 1.6 of the prolongation 1.3. For this purpose, the boat skin 1.6 is stretched or spanned over the rods 8.1, 8.2 and 8.3.

Figure 5:
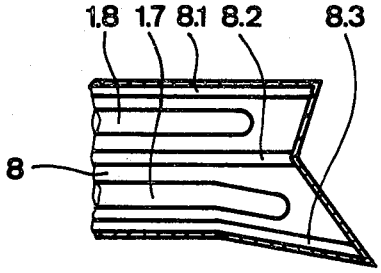

A variant of the propulsion fin 8 is partially illustrated in FIG. 5. This variant, in addition to the construction according to FIG. 4, contains longitudinal inflatable ribs 1.7 and 1.8 between the rods 8.1, 8.2 and 8.3. The ribs 1.7 and 1.8 are enclosed by the boat skin 1.6.

Figure 6:
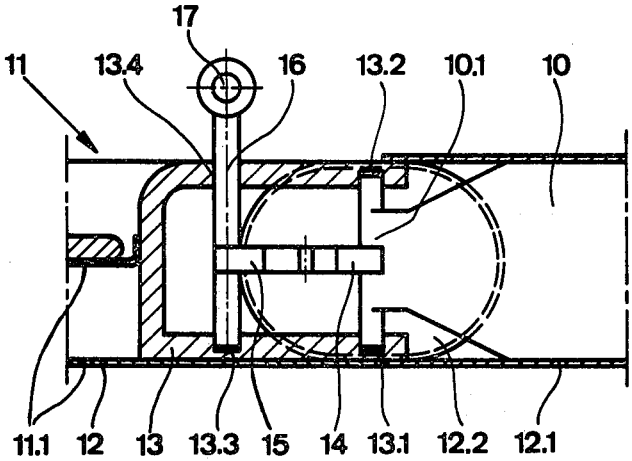
FIGS. 6 to 8 show three further embodiments, illustrated only partially and in longitudinal sectional view, of watercraft constructed according to the invention.
Figure 7:
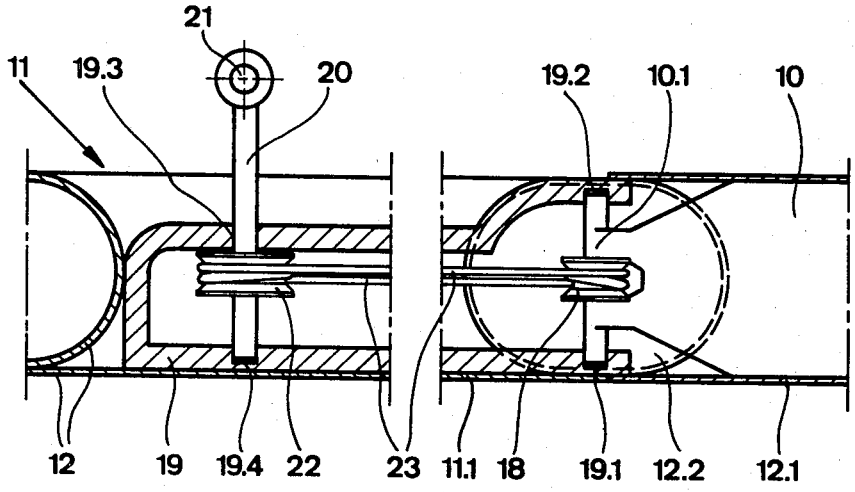
Figure 8:
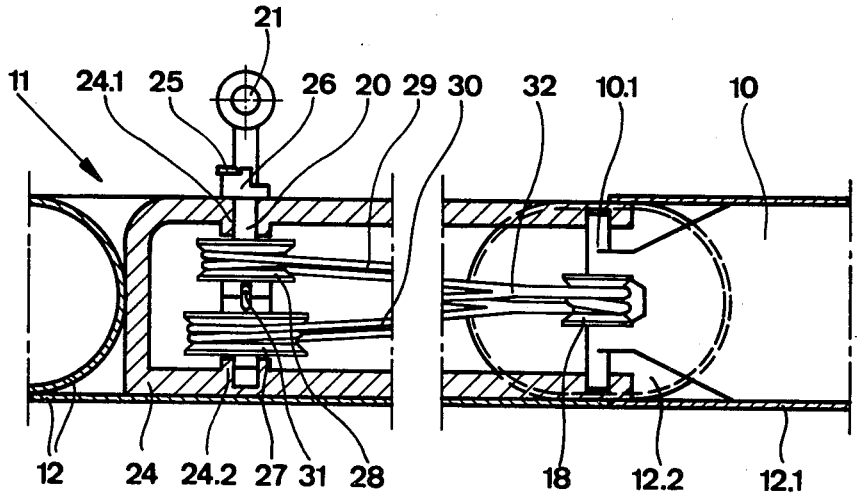

FIGS. 6 to 8 show, slightly enlarged compared with the FIGS. 1 and 2, three further possible embodiments of a watercraft constructed according to the invention. As in the arrangement of FIGS. 1 and 2, the watercraft comprises a pneumatic hose boat 11, the inflatable torus 12.2 which has the shape of a loop not closed at the stern, wherein a flexible prolongation 12.1 of the boat skin 12 at least partially encompasses in watertight fashion a propulsion fin 10. Differing from the embodiments of FIGS. 1 and 2, here, a swivel axle or shaft, constructed as a drive shaft 10.1, of the propulsion fin 10, is driven not directly, but rather by means of a force transmission mechanism, as will be considered more fully hereinafter.

In the embodiment illustrated in FIG. 6, both of the ends of the drive shaft 10.1 are guided in two bearings 13.1 and 13.2 or the like of a bracket arranged between both of the torus ends, wherein the bracket consists of the rear parts of a fixed housing 13. The fixed housing 13 is coverable by the boat skin 12 and fastened by means of a not shown, detachable or undetachable connection to the boat bottom floor 11.1 and to the torus ends. Provided in the middle of the drive shaft 10.1 is a toothed element 14 or equivalent structure, which engages with another toothed element 15, which is fastened on a vertical actuating or actuation shaft 16. Both of the toothed elements 14 and 15 can be gear wheel sectors or gear wheels of different radii. The lower end of the actuating shaft 16 is rotatably journalled in another bearing 13.3 of the housing 13. The upper part of the actuating shaft 16 is guided in a passage or bore 13.4 of the housing 13 and extends upwardly out of the pneumatic hose boat 11. An actuating lever 17 or equivalent actuating means is fastened to the upper end of the actuating shaft 16. Bevel gears or bevel gear sectors also can be provided as toothed elements, wherein these toothed elements are connected with one another through a transmission shaft which is equipped with bevel gears or bevel gear sectors at both ends. In this arrangement, the actuating shaft 16 can be provided in the bow of the pneumatic hose boat 11.

The user can swivel the actuating lever 17 by his or her feet, as in the embodiment of FIGS. 1 and 2, or, in case the actuating shaft 16 is arranged in the bow of the pneumatic hose boat 11, also by his or her hands.

FIGS. 7 and 8 illustrate two embodiments, in which a vertical actuating shaft 20 is arranged in the bow of the pneumatic hose boat 11. The actuating shaft 20 and the drive shaft 10.1 are equipped with drive wheels or pulleys 18 and 22 which are connected with one another by flexible tension elements or means 23. In both embodiments, rope pulley 18 is fastened as a drive wheel to the drive shaft 10.1 of the propulsion fin 10.

In the embodiment shown in FIG. 7, as in the arrangement of FIG. 6, both the ends of the drive shaft 10.1 are guided in two bearings 19.1 and 19.2 of a bracket arranged between both of the torus ends, wherein the bracket consists of the rear parts of a stationary or fixed housing 19. The housing 19 is coverable by the boat skin 12 and fastened by means of any suitable and thus not particularly shown, detachable or undetachable connection to the boat bottom or bottom floor 11.1 and at the torus ends. The lower end of the actuating shaft 20 arranged in the bow of the pneumatic hose boat 11 is journalled in a bearing 19.4 or equivalent structure of the housing 19, while the upper part thereof is guided in a passage or bore 19.3. An actuating lever 21 or equivalent actuating means is fastened to the upper end of the actuating shaft 20. The part of the actuating shaft 20 arranged in the interior of the housing 19 carries rope pulley 22. The two rope pulleys 18 and 22 are connected with each other by means of the traction or tension means shown as a tension rope or cable 23 or the like. The tension rope 23 is fastened on both rope pulleys 18 and 22 by any standard respective not particularly shown fastening means, wherein both the rope pulleys 18 and 22 are so constructed that the tension rope 23 is windable therearound at least once. Consequently, the transition from the tension rope 23 to the pulleys 18 and 22 is always tangential.

In dependence upon the position of the user, he or she can actuate the actuating lever 21 by his or her hands or feet.

FIG. 8 shows a variant embodiment, in which the actuating shaft 20 is journalled to be vertically displaceable in a passage or bore 24.1 and in a bearing 24.2 of a housing 24. Fastened to the actuating shaft 20 is a supporting pin 25 which rests on a stepped ring 26. The stepped ring 26 rotatably encompasses the actuating shaft 20 between the support pin 25 and the housing 24 and rests rotatably thereon. To vary the angular speed of the propulsion fin 10, two rope or cable pulleys 27 and 28 are provided on the actuating shaft 20. In accordance with the vertical position, in which the actuating shaft 20 is held by the stepped ring 26, one of the two rope pulleys 27 and 28 is coupled by means of a coupling pin 31 to the actuating shaft 20. A respective cable or rope 29 or 30 is wound around both rope pulleys 27 or 28. The ends of both the ropes or cables 29 and 30 are connected with a common tension rope or cable 32, which is wound around the rope pulley 18 fastened to the drive shaft 10.1. In place of a common rope pulley 18, two rope pulleys can be arranged above one another on the drive shaft 10.1 and can be connected by means of two individual ropes or cables with the corresponding rope pulleys 27 and 28 of the actuating shaft 20.

In the case of the last two described embodiments, a seat can be provided for the user in the pneumatic hose boat 11 above the housing 19 and 24. This seat can be produced separately or together with the related housing 19 and 24.

It is clearly within the scope and teachings of the invention to realize the transmission of the movements between the actuating shaft 16 and 20 and the drive shaft 10.1 by a chain which runs on chain or sprocket wheels or by other flexible tension elements. In that case it is obvious to tighten the flexible tension elements by any suitable tightening device.

Other coupling devices also can be provided in place of the coupling device of the rope pulleys 27 and 28 with the actuating shaft 20 shown in FIG. 8.

It likewise lies within the scope and teachings of the invention to drive the propulsion fin 3, 8 and 10 instead of the muscle power of one user, by the muscle power of several users or by a motor.

The inflatable torus 1.2 and 12.2 also can have the shape of a closed loop and/or be divided into several parts.

Furthermore, the respective swivel axle or shaft 3.1, 9 and 10.1 of the corresponding propulsion fin 3, 8 and 10 arranged in the prolongation 1.3 and 12.1 of the watercraft 1 and 11, respectively, also can be disposed outside the contour or outline of the boat. The flexible boat skin may of course fully enclose in a watertight fashion the swivellable propulsion fin.

While there are shown and described present preferred embodiments of the invention, it is to be distinctly understood that the invention is not limited thereto, but may be otherwise variously embodied and practiced within the scope of the following claims. Accordingly,

What I claim is:

1. A watercraft comprising:

watercraft body means including means for defining a prolongation thereof;

said watercraft body means having a longitudinal direction of extent and a stern;

a propulsion fin provided for said body means;

said propulsion fin having an impact surface;

means including a substantially vertical swivel axle for mounting said propulsion fin to be laterally swivellable;

drive means for laterally swivelling said propulsion fin;

said propulsion fin extending from said substantially vertical swivel axle substantially parallel to said longitudinal direction of extent of said watercraft body means and in alignment with said longitudinal direction of extent;

said propulsion fin being arranged at the stern in the prolongation of the watercraft body means;

said watercraft body means defining a pneumatic hose boat having a boat skin which at the stern thereof contains said prolongation which encloses in a watertight fashion the impact surface of said swivellable propulsion fin over its entire height; and said pneumatic hose boat including an inflatable torus having at the stern thereof two spaced ends between which the substantially vertical swivel axle of the propulsion fin is disposed.

2. The watercraft as defined in claim 1, wherein:

said substantially vertical swivel axle of said propulsion fin is arranged within the contour of said body means of said watercraft.

3. The watercraft as defined in claim 1, wherein:

said propulsion fin includes a core composed of a plate; and said plate being almost rigid in the proximity of said swivel axle and becoming more flexible with increasing spacing from said swivel axle.

4. The watercraft as defined in claim 1, wherein:

said propulsion fin comprises a framework of rods extending in the direction of propulsion of said watercraft body means;

said framework of rods being almost rigid in the proximity of said swivel axle and becoming more flexible with increasing spacing from said swivel axis; and said propulsion fin having impact surface means composed of the boat skin spanned over said rods.

5. The watercraft as defined in claim 1, wherein:

said vertical swivel axle of the propulsion fin comprises a drive shaft; and said drive means including an actuating lever rotatable about a substantially vertical axis of rotation.

6. The watercraft as defined in claim 5, wherein:

said actuating lever is secured essentially at right angles with respect to said propulsion fin; and said actuating lever having an intermediate portion.

7. The watercraft as defined in claim 5, further including:

an actuating shaft to which there is secured said actuating lever; and a respective toothed element provided for each said actuating shaft and said drive shaft of the propulsion fin.

8. The watercraft as defined in claim 7, wherein:

said toothed elements cooperate with one another for providing force transmission between said actuating lever and said drive shaft.

9. The watercraft as defined in claim 7, wherein:

said toothed elements meshingly engage with one another.

10. The watercraft as defined in claim 5, further including:

an actuating shaft with which there is operatively connected said actuating lever;

drive wheel means provided for said actuating shaft;

drive wheel means provided for said drive shaft of the propulsion fin; and flexible tension means for operatively interconnecting said drive wheel means of said actuating shaft with said drive wheel means of said drive shaft.

11. The watercraft as defined in claim 10, wherein:

said flexible tension means comprises rope means; and said drive wheel means each comprising a rope pulley around which there is windable at least once said rope means which is fastened to said rope pulleys.

12. The watercraft as defined in claim 10, wherein:

said drive wheel means of said actuating shaft comprises a plurality of rope pulleys;

coupling means for individually coupling said plurality of rope pulleys with said actuating shaft; and said flexible tension means comprising a respective rope wound around each of said rope pulleys of said actuating shaft.

13. The watercraft as defined in claim 12, wherein:

said drive wheel means of said drive shaft comprising a rope pulley; and a tension rope common to said respective ropes for winding said respective ropes around said rope pulley of said drive shaft.

14. The watercraft as defined in claim 10, further including:

separate housing means provided with bearing means for guiding the said shafts; and all of the components of said drive means for the propulsion fin, with the exception of said actuating lever, being disposed within said housing means.

15. The watercraft as defined in claim 1, wherein:

said substantially vertical swivel axle of the propulsion fin includes a drive shaft; and said drive means for laterally swivelling said propulsion fin includes:

an actuating lever rotatable about a substantially vertical axis of rotation;

a vertical actuating shaft to which there is secured said actuating lever; and a force transmission mechanism operatively interconnecting said actuating shaft with said drive shaft; and further wherein:

said pneumatic hose boat includes separate housing means, provided with bearing means, for guiding said actuating shaft and said drive shaft; and said drive shaft and all components of said drive means, with the exception of said actuating lever, are disposed within said separate housing means.

* * * * *